US010638836B2

(12) United States Patent
Chen et al.

(10) Patent No.: US 10,638,836 B2
(45) Date of Patent: May 5, 2020

(54) ADJUSTMENT MECHANISM

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Fang-Cheng Su, Kaohsiung (TW); Ci-Bin Huang, Kaohsiung (TW); Yue-Hua Tang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 16/217,261

(22) Filed: Dec. 12, 2018

(65) Prior Publication Data

US 2020/0037761 A1 Feb. 6, 2020

(30) Foreign Application Priority Data

Jul. 31, 2018 (TW) ..... 107126812 A

(51) Int. Cl.
*A47B 88/00* (2017.01)
*A47B 88/407* (2017.01)

(52) U.S. Cl.
CPC ..... *A47B 88/407* (2017.01)

(58) Field of Classification Search
CPC .... A47B 2088/4276; A47B 2088/4278; A47B 88/427; A47B 88/407; A47B 88/49; A47B 88/57; A47B 2088/4272; A47B 2088/4274; A47B 88/40; A47B 88/423; A47B 88/483; A47B 88/956
USPC ..... 312/334.1, 334.4, 334.5, 334.6
See application file for complete search history.

(56) References Cited

U.S. PATENT DOCUMENTS

| | | | | |
|---|---|---|---|---|
| 8,854,769 | B1 | 10/2014 | Liang et al. | |
| 8,979,223 | B2 | 3/2015 | Huang | |
| 8,991,952 | B2 * | 3/2015 | Salice | A47B 88/427 312/334.4 |
| 9,060,604 | B2 | 6/2015 | Salice | |
| 9,125,490 | B2 | 9/2015 | Haemmerle et al. | |
| 9,179,771 | B2 | 11/2015 | Haemmerle et al. | |
| 9,907,399 | B2 | 3/2018 | Lucas | |

(Continued)

FOREIGN PATENT DOCUMENTS

| | | | |
|---|---|---|---|
| AT | 510714 | * | 6/2012 |
| EP | 2929804 | * | 9/2016 |

(Continued)

*Primary Examiner* — Janet M Wilkens
(74) *Attorney, Agent, or Firm* — Rosenberg, Klein & Lee

(57) ABSTRACT

An adjustment mechanism includes a first component, a second component, an adjusting element, and a structure. The adjusting element is arranged on the first component. The structure is arranged on the second component. The adjusting element and the structure include a first feature and a second feature respectively, wherein the first and the second features correspond to each other. When the adjusting element is operated, the first feature and the second feature work with each other to longitudinally displace, and thereby adjust, the second component and the first component with respect to each other.

17 Claims, 11 Drawing Sheets

(56) References Cited

U.S. PATENT DOCUMENTS

| | | | | |
|---|---|---|---|---|
| 2013/0113356 | A1* | 5/2013 | Salice | A47B 88/427<br>312/334.44 |
| 2015/0147008 | A1* | 5/2015 | McGregor | A47B 88/407<br>384/22 |
| 2017/0347794 | A1* | 12/2017 | McGregor | A47B 88/49 |

FOREIGN PATENT DOCUMENTS

| | | | |
|---|---|---|---|
| EP | 3372114 | * | 9/2018 |
| EP | 3372115 | * | 9/2018 |
| WO | 2012092634 | * | 7/2012 |

* cited by examiner

ADJUSTMENT MECHANISM

FIELD OF THE INVENTION

The present invention relates to an adjustment mechanism and more particularly to an adjustment mechanism that enables longitudinal adjustment.

BACKGROUND OF THE INVENTION

Generally, an undermount drawer slide rail assembly is mounted on a bottom portion of a drawer and is therefore hidden from view. Such a slide rail assembly typically includes a first rail and a second rail that can be displaced with respect to the first rail, wherein the first rail is mounted on the body of a cabinet while the second rail serves to carry or support a drawer so that the drawer can be easily pulled out of and pushed back into the cabinet body via the second rail with respect to the first rail. When the drawer is pulled out of the cabinet body, the undermount drawer slide rail assembly stays hidden at the bottom of the drawer.

It is well known in the art of furniture slide rails that a drawer can be adjusted, or displaced, with respect to the cabinet body in which it is installed (or with respect to certain slide rails). U.S. Pat. No. 9,060,604 B2, for example, discloses a device (10) for laterally centering a drawer. The device (10) includes a first coupling part (26) and a second coupling part (27), which are respectively connected to a hooking device (12) of a drawer (13) and a pull-out guide (11). The first coupling part (26) and the second coupling part (27) are conformed with elastically yieldable means in a lateral direction in order to cause a forced engagement and/or a shaped engagement between the first coupling part (26) and the second coupling part (27), thereby compensating for any lateral play between the hooking device (12) and the pull-out guide (11). The disclosure of this US patent is incorporated herein by reference.

SUMMARY OF THE INVENTION

The present invention relates to an adjustment mechanism that enables longitudinal adjustment.

According to one aspect of the present invention, an adjustment mechanism includes a first adjustment device, and the first adjustment device includes a first component, a second component, a first adjusting element, and a first structure. The first adjusting element is disposed on the first component while the first structure is disposed on the second component. The first adjusting element and the first structure include a first feature and a second feature respectively, wherein the first and the second features correspond to each other. When the first adjusting element is operated, the first and the second features work with each other to longitudinally displace, and thereby adjust, the second component and the first component with respect to each other.

Preferably, the first feature of the first adjusting element and the second feature of the first structure are screw threads that are threadedly engaged with each other.

Preferably, the first adjusting element is a turning wheel, the first structure is a rod and is substantially longitudinally disposed with respect to the second component, and the first adjusting element is configured to be operated by rotation about an axis defined by the first structure.

Preferably, the first component includes a pair of walls, and the pair of walls define a space therebetween for accommodating the first adjusting element. Preferably, the second component includes a mounting portion for supporting the first structure, and the first structure has a first abutting portion and a second abutting portion that are located on two opposite sides of the mounting portion respectively.

Preferably, the first adjusting element is slightly smaller than the space and can therefore be operated by rotation about the axis defined by the first structure, and the pair of walls prevent the first adjusting element from being longitudinally displaced.

Preferably, the first and the second components include a first longitudinal guiding feature and a second longitudinal guiding feature respectively. The first and the second longitudinal guiding features are configured to work with each other, and one of the first and the second longitudinal guiding features is larger than the other of the first and the second longitudinal guiding features.

Preferably, the first longitudinal guiding feature is a recess or a hole, and the second longitudinal guiding feature is a protruding portion.

Preferably, the second component has a longitudinal opening, and the adjustment mechanism further includes a first connecting member. The first connecting member includes a head and a body, wherein the head is larger than the body. The body of the first connecting member extends through a portion of the longitudinal opening and is connected to the first component, with the head of the first connecting member stopped on one side of the second component.

Preferably, the adjustment mechanism further includes a second adjustment device, and the second adjustment device includes a third component, a second adjusting element, and a second structure. The second adjusting element is disposed on the second component while the second structure is disposed on the third component. The second adjusting element includes an adjusting portion. When the second adjusting element is operated, the adjusting portion and the second structure work with each other to transversely displace, and thereby adjust, the second component and the third component with respect to each other.

Preferably, the second adjusting element is a turning wheel, the second structure is a projection, the adjusting portion of the second adjusting element is a generally spiral guide groove, and the second structure is in the guide groove.

Preferably, the second and the third components include a first transverse guiding feature and a second transverse guiding feature respectively. The first and the second transverse guiding features are configured to work with each other, and one of the first and the second transverse guiding features is larger than the other of the first and the second transverse guiding features.

Preferably, the second component includes at least one guiding structure for keeping at least one corresponding edge portion of the third component in place.

Preferably, the third component has a first space larger than the head of the first connecting member.

Preferably, the adjustment mechanism further includes a second connecting member, and the third component includes a transverse opening. The second connecting member includes a head and a body, wherein the head is larger than the body. The body of the second connecting member extends through a portion of the transverse opening of the third component and is connected to the second component, with the head of the second connecting member stopped on one side of the third component.

Preferably, the first component has a second space larger than the body of the second connecting member.

Preferably, the third component includes a connecting portion for connecting the third component to a target object.

Preferably, the third component further includes a flexible arm, and the flexible arm has a plurality of engaging sections for engaging with the target object.

According to another aspect of the present invention, an adjustment mechanism is provided for use with a slide rail. The adjustment mechanism includes a first component, a second component, a first adjusting element, a first structure, a third component, a second adjusting element, and a second structure. The first component is connectable to an object carried by the slide rail. The first adjusting element is disposed on one of the first and the second components while the first structure is disposed on the other of the first and the second components. The third component is connectable to the slide rail. The second adjusting element is disposed on one of the second and the third components while the second structure is disposed on the other of the second and the third components. The first adjusting element and the first structure include a first feature and a second feature respectively. The first and the second features correspond to each other and are configured to work with each other to convert rotation of the first adjusting element into longitudinal displacement of the first component with respect to the second component, thereby adjusting the longitudinal position of the object with respect to the slide rail. The second adjusting element includes an adjusting portion, and the adjusting portion and the second structure are configured to work with each other to convert rotation of the second adjusting element into transverse displacement of the second component with respect to the third component, thereby adjusting the transverse position of the object with respect to the slide rail.

DETAILED DESCRIPTION OF THE INVENTION

Figure 1:
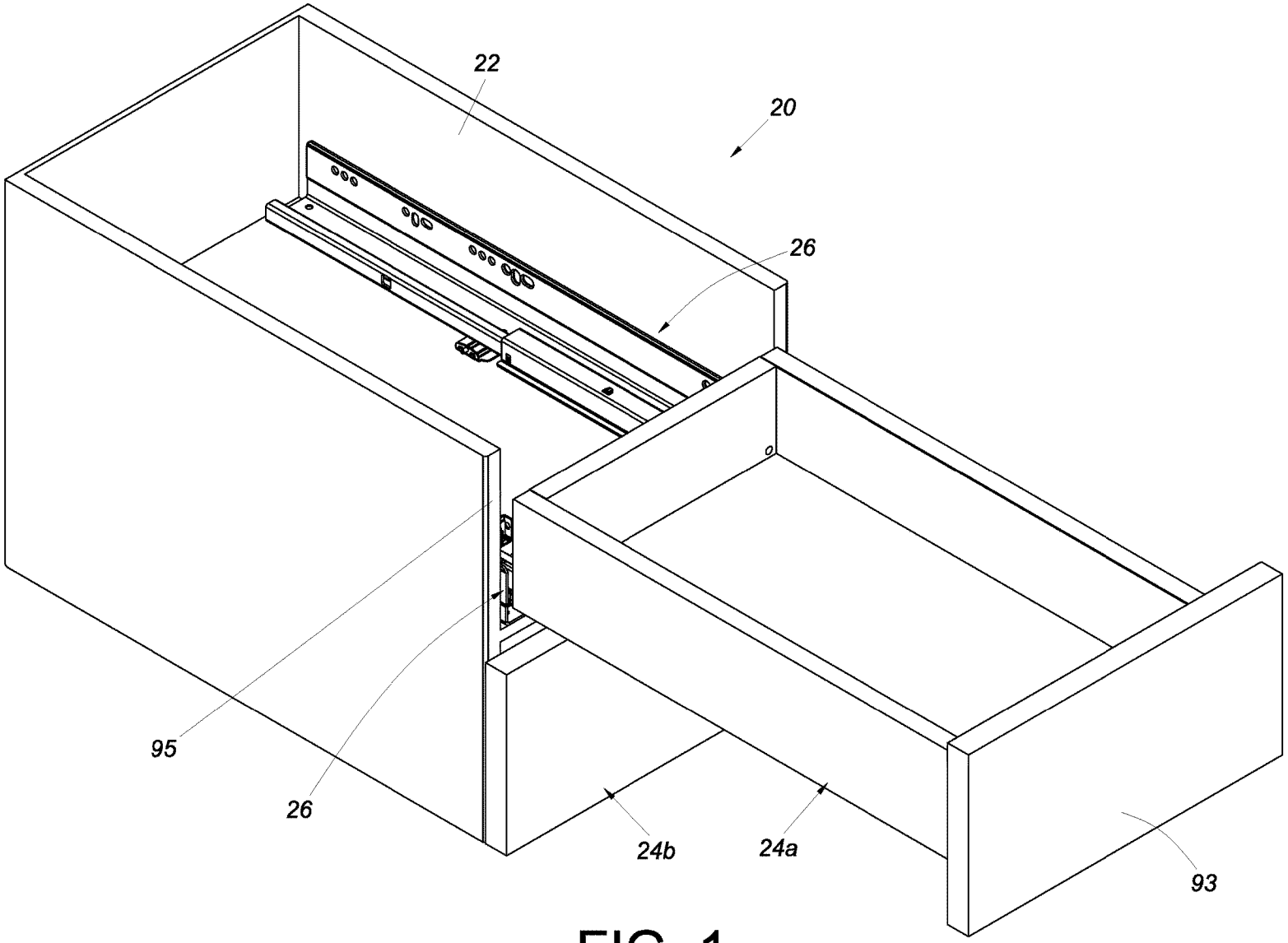
FIG. 1 is a perspective view of a piece of furniture according to an embodiment of the present invention, wherein the furniture includes a first furniture part and two second furniture parts, and wherein one of the second furniture parts is pulled out of the first furniture part via a pair of slide rail assemblies.
Figure 2:
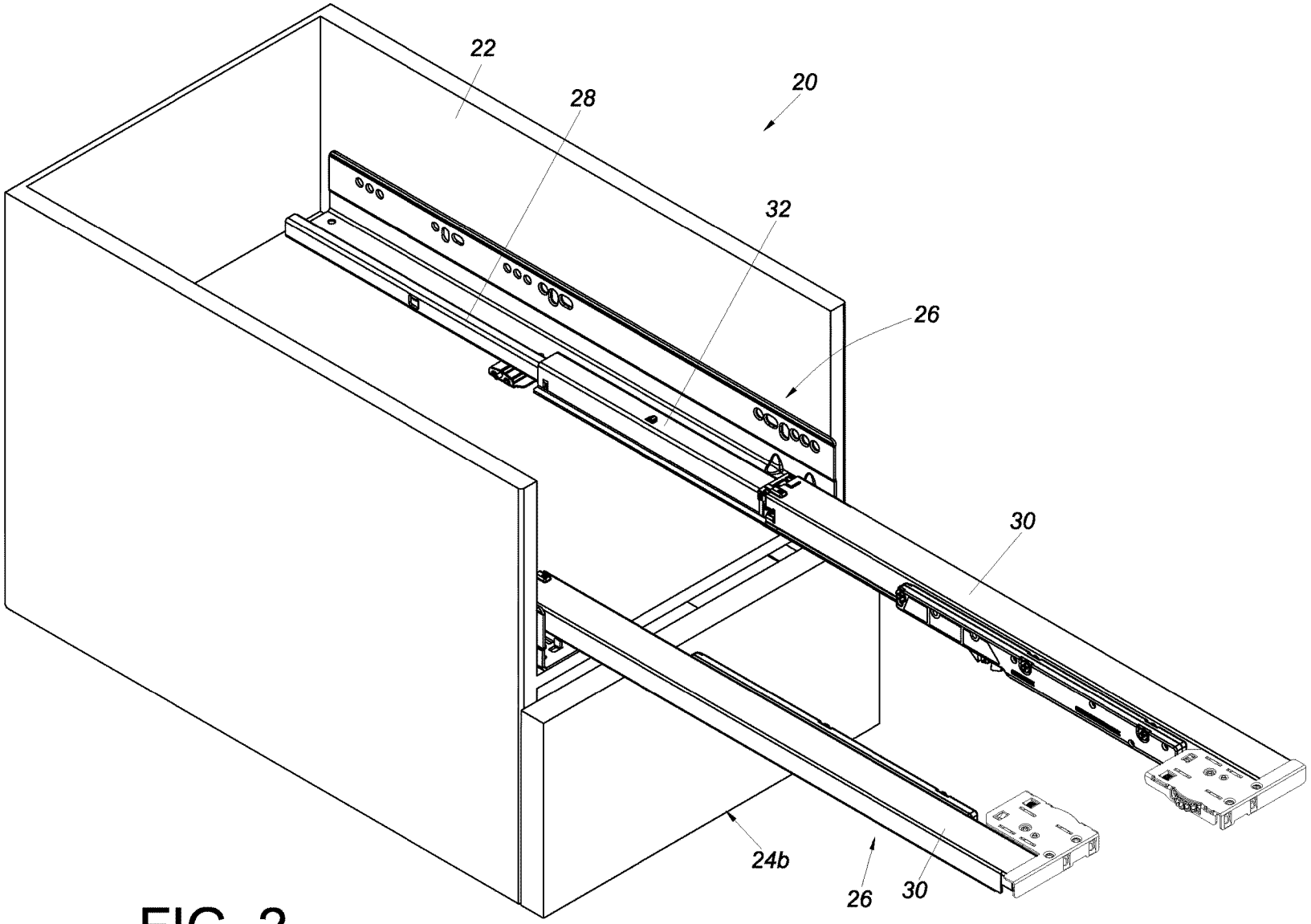
FIG. 2 is similar to FIG. 1 except that the pulled-out second furniture part is removed.

Referring to FIG. 1 and FIG. 2, a piece of furniture 20 includes a first furniture part 22 and at least one second furniture part. Here, two second furniture parts 24*a*, 24*b* are shown by way of example. Each of the second furniture parts, such as the second furniture part 24*a*, can be displaced with respect to the first furniture part 22. Preferably, the second furniture part 24*a* can be easily displaced with respect to the first furniture part 22 via a pair of slide rail assemblies 26. The first furniture part 22 may be the body of a furniture cabinet, and the two second furniture parts 24*a*, 24*b* may be drawers; the present invention has no limitation in this regard. The second furniture part 24*a* is mounted on the first furniture part 22 through the pair of slide rail assemblies 26 in a movable manner. The slide rails of each slide rail assembly 26 are mounted on a bottom portion of the second furniture part 24*a* to form a so-called undermount slide rail assembly. More specifically, each slide rail assembly 26 includes a first rail 28, a second rail 30 (referred to in the claims as a slide rail) longitudinally displaceable with respect to the first rail 28, and preferably also a third rail 32 movably mounted between the first rail 28 and the second rail 30 to increase the distance for which the second rail 30 can be displaced with respect to the first rail 28. The first rails 28 are fixedly mounted on the first furniture part 22. The second rails 30 are configured to carry the second furniture part 24*a* (referred to in the claims as an object) so that the second furniture part 24*a* can be easily displaced via the second rails 30 from inside the first furniture part 22 to a position outside the first furniture part 22 and vice versa.

Figure 3:
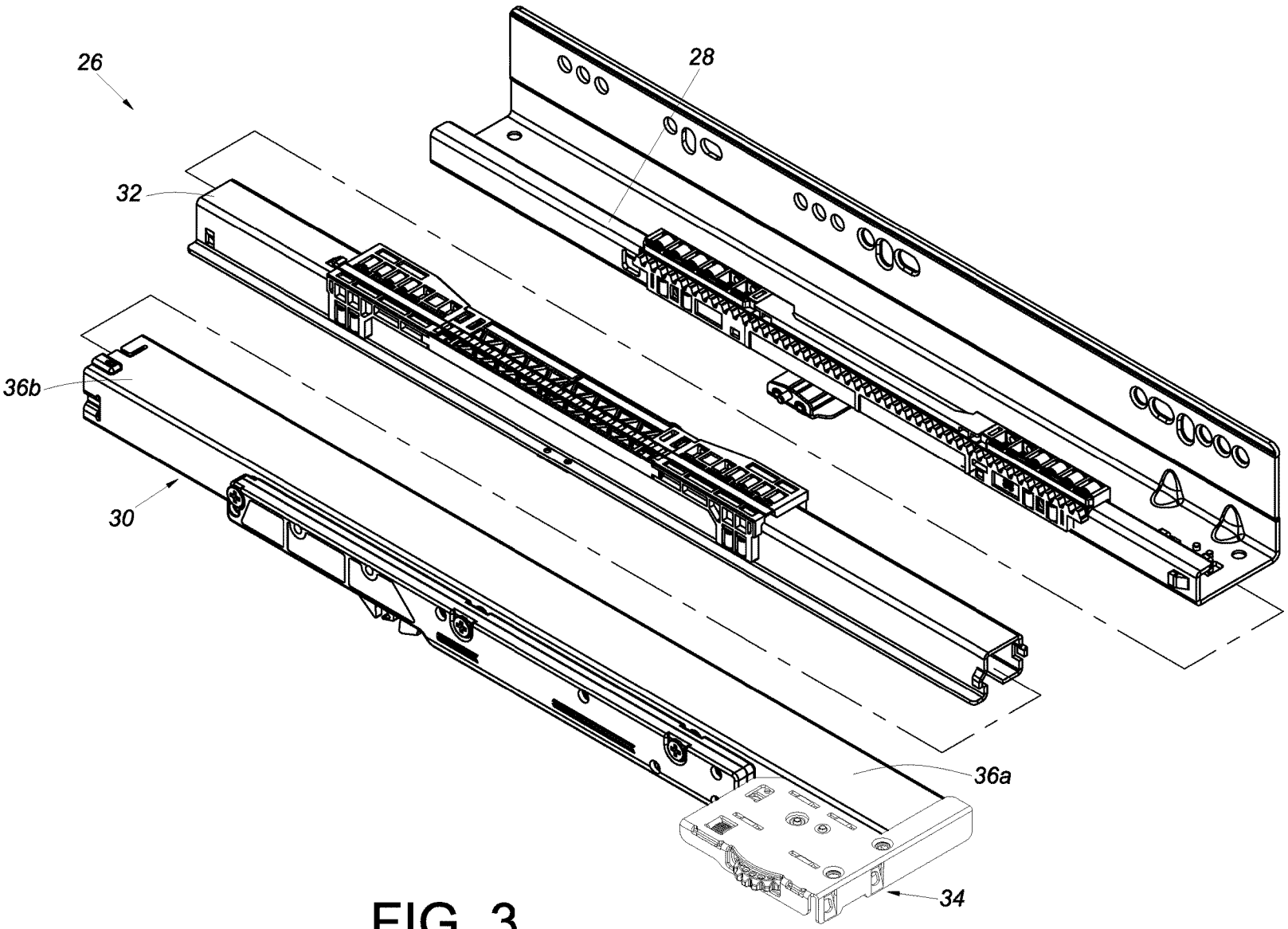
FIG. 3 is an exploded perspective view of the slide rail assembly according to the embodiment of the present invention.
Figure 4:
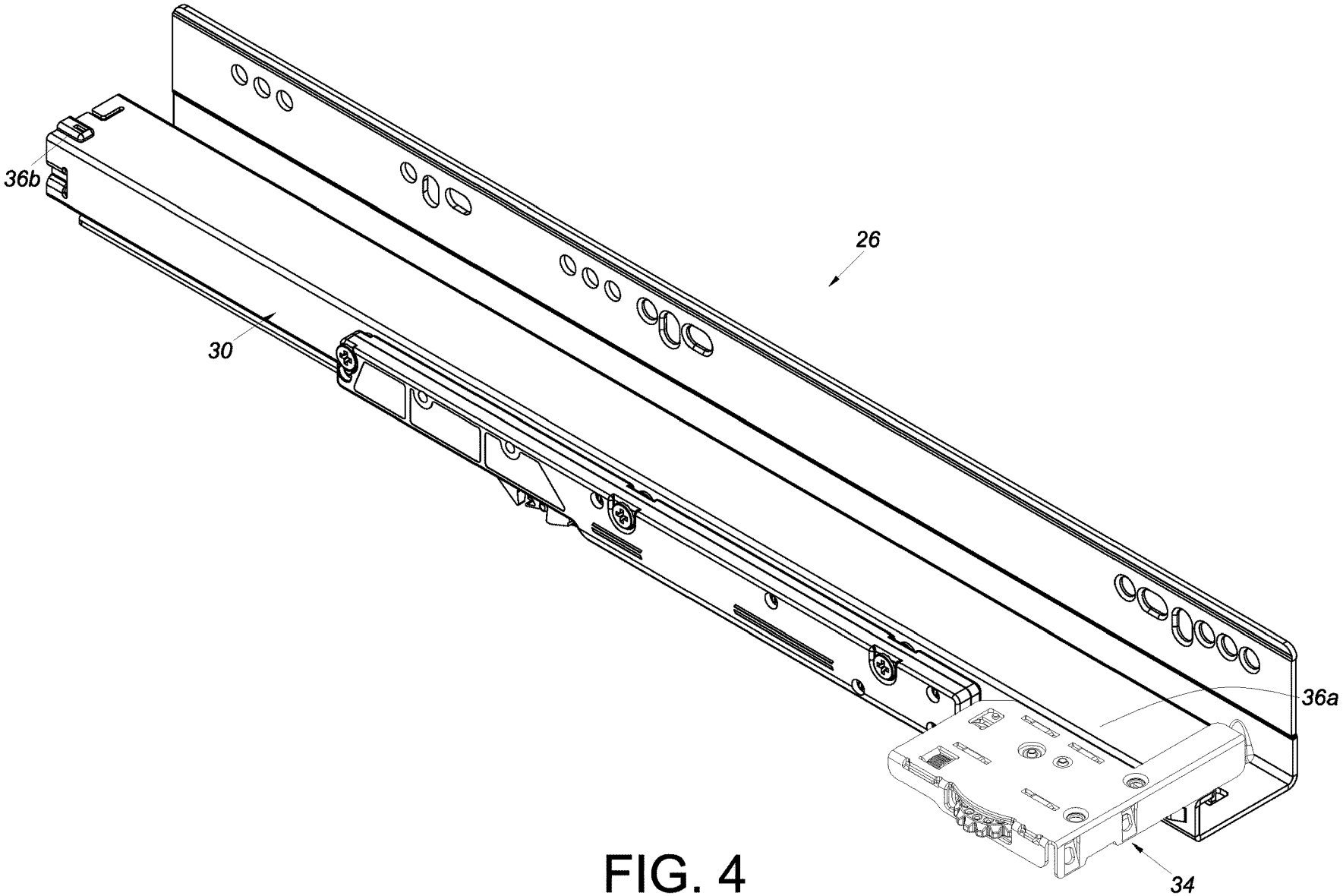
FIG. 4 is an assembled perspective view of the slide rail assembly according to the embodiment of the present invention.

As shown in FIG. 3 and FIG. 4, the slide rail assembly 26 includes an adjustment mechanism 34 adjacent to the second rail 30. Here, the second rail 30 has a front portion 36*a* and a rear portion 36*b*, and the adjustment mechanism 34 is mounted adjacent to the front portion 36*a* of the second rail 30 by way of example.

As shown in FIG. 5, FIG. 6, FIG. 7, and FIG. 8, the adjustment mechanism 34 includes a first component 42, a second component 44, a first adjusting element 46, and a first structure 48. The first component 42, the second component 44, the first adjusting element 46, and the first structure 48 constitute a first adjustment device. Preferably, the adjustment mechanism 34 further includes a third component 50, a second adjusting element 52, and a second structure 54. The second component 44, the third component 50, the second adjusting element 52, and the second structure 54 constitute a second adjustment device.

The first adjusting element 46 is arranged on one of the first component 42 and the second component 44. Here, the first adjusting element 46 is arranged on the first component 42 by way of example but not limitation.

The first structure 48 is arranged on the other of the first component 42 and the second component 44. Here, the first structure 48 is arranged on the second component 44 by way of example but not limitation.

The first adjusting element 46 and the first structure 48 include a first feature 56 and a second feature 58 respectively, wherein the first feature 56 and the second feature 58 correspond to each other. Preferably, the first feature 56 of the first adjusting element 46 and the second feature 58 of the first structure 48 are screw threads that are threadedly engaged with each other. For example, the first adjusting element 46 is a turning wheel, the first feature 56 of the first adjusting element 46 is an internal thread, the first structure 48 is a rod, and the second feature 58 of the first structure 48 is an external thread. Preferably, the first structure 48 is substantially longitudinally disposed with respect to the second component 44, and the first adjusting element 46 can be operated by being rotated about an axis defined by the first structure 48.

Preferably, the first component 42 includes a pair of walls, such as a first wall 60*a* and a second wall 60*b*. The pair of walls 60*a*, 60*b* define a space 62 therebetween, and the space 62 is used to accommodate the first adjusting element 46. Preferably, the first adjusting element 46 is slightly smaller than the space 62 so as to be rotatable about the axis defined by the first structure 48 when operated. The pair of walls 60*a*, 60*b* can also prevent the first adjusting element 46 from longitudinal displacement. For example, the pair of walls 60*a*, 60*b* are configured to abut against the first adjusting element 46 so that the first adjusting element 46 cannot be longitudinally moved. (To be exact, the first adjusting element 46, which is slightly smaller than the space 62, is longitudinally displaceable only to a very limited extent, which is negligible.) The second component 44 includes a mounting portion 64 for supporting the first structure 48. Preferably, the second component 44 further includes a mounting wall 66. The first structure 48 has a first end portion E1 and a second end portion E2, with the second feature 58 lying between the first end portion E1 and the second end portion E2. The first end portion E1 of the first structure 48 is disposed on the mounting portion 64; the second end portion E2 of the first structure 48 extends through the mounting wall 66. Preferably, the first structure 48 has a first abutting portion 66*a* and a second abutting portion 66*b* (see FIG. 5) that correspond to, or are configured to abut against, two opposite sides of the mounting portion 64 respectively.

Preferably, the first component 42 and the second component 44 include a first longitudinal guiding feature 70 and a second longitudinal guiding feature 72 respectively, wherein the first longitudinal guiding feature 70 and the second longitudinal guiding feature 72 are configured to work with each other, and wherein one of the first longitudinal guiding feature 70 and the second longitudinal guiding feature 72 is larger than the other of the first longitudinal guiding feature 70 and the second longitudinal guiding feature 72. Here, the first longitudinal guiding feature 70 has a greater longitudinal length than the second longitudinal guiding feature 72 by way of example but not limitation. Preferably, the first longitudinal guiding feature 70 is a recess or a hole while the second longitudinal guiding feature 72 is a protruding portion. The first longitudinal guiding feature 70 and the second longitudinal guiding feature 72 allow the first component 42 and the second component 44 to be longitudinally displaced with respect to each other to a limited extent. In this embodiment, and by way of example, there are a plurality of first longitudinal guiding features 70 and a plurality of second longitudinal guiding features 72 that correspond to and are configured to work with one another; in practice, there is no limitation on the number of the first and the second longitudinal guiding features 70, 72.

Preferably, the second component 44 includes a longitudinal opening 74, and the adjustment mechanism 34 further includes a first connecting member 76. The first connecting member 76 includes a head 76*a* and a body 76*b*, wherein the head 76*a* is larger than the body 76*b*. The body 76*b* of the first connecting member 76 passes through a portion of the longitudinal opening 74 to connect with the first component 42, with the head 76*a* of the first connecting member 76 stopped on one side of the second component 44.

The second adjusting element 52 is arranged on one of the second component 44 and the third component 50. Here, the second adjusting element 52 is arranged on the second component 44 by way of example but not limitation. The second adjusting element 52 includes an adjusting portion 53.

The second structure 54 is arranged on the other of the second component 44 and the third component 50. Here, the second structure 54 is arranged on the third component 50 by way of example but not limitation.

Preferably, the second adjusting element 52 is a turning wheel. For example, the second adjusting element 52 is mounted on a shaft portion 78 of the second component 44 and can be operated by being rotated about an axis defined by the shaft portion 78. Preferably, the second structure 54 is a projection, the adjusting portion 53 of the second adjusting element 52 is a generally spiral guide groove, and the second structure 54 is in the guide groove (see FIG. 8). Preferably, the axis of the first adjusting element 46 is perpendicular to that of the second adjusting element 52; that is to say, the direction along which the first structure 48 is disposed is perpendicular to the direction along which the shaft portion 78 is disposed.

Preferably, the second component 44 and the third component 50 include a first transverse guiding feature 80 and a second transverse guiding feature 82 respectively, wherein the first transverse guiding features 80 and the second transverse guiding feature 82 are configured to work with each other, and wherein one of the first transverse guiding feature 80 and the second transverse guiding feature 82 is large than the other of the first transverse guiding feature 80 and the second transverse guiding feature 82. Here, the first transverse guiding feature 80 has a greater transverse length than the second transverse guiding feature 82 by way of example but not limitation. Preferably, the first transverse guiding feature 80 is a recess or a hole while the second transverse guiding feature 82 is a protruding portion. The first transverse guiding feature 80 and the second transverse guiding feature 82 allow the second component 44 and the third component 50 to be transversely displaced with respect to each other to a limited extent. In this embodiment, and by way of example, there are a plurality of first transverse guiding features 80 and a plurality of second transverse guiding features 82 that correspond to and are configured to work with one another; in practice, there is no limitation on the number of the first and the second transverse guiding features 80, 82.

Figure 5:
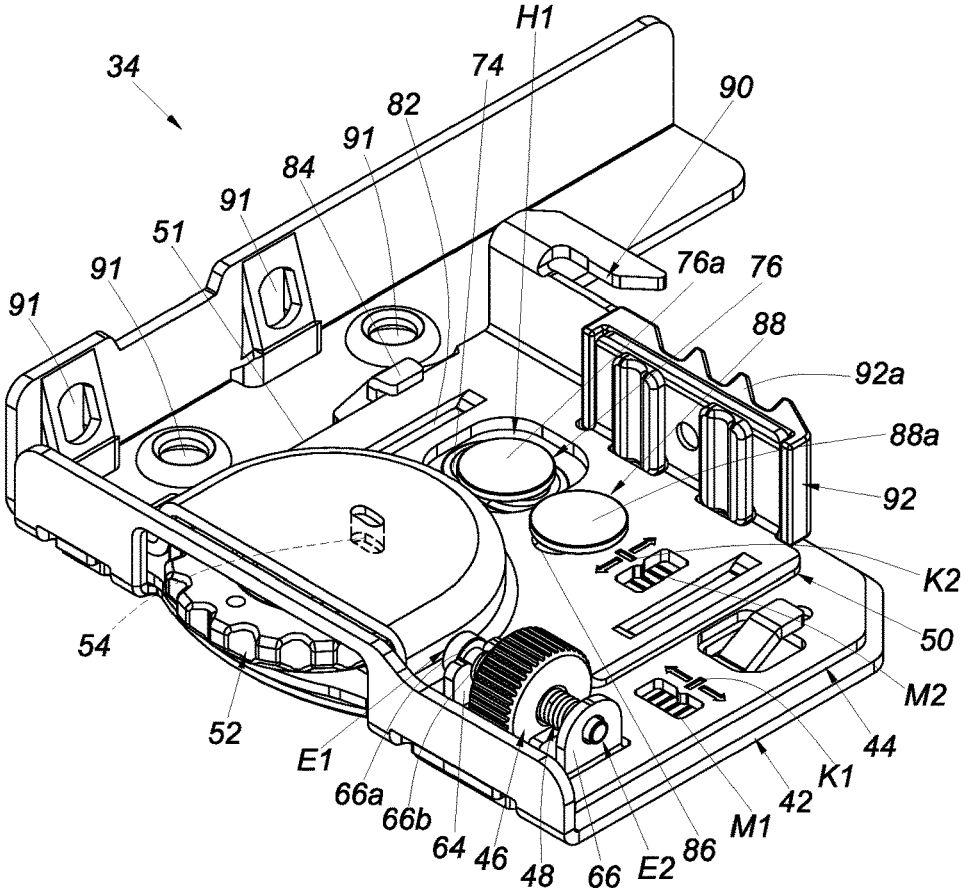
FIG. 5 is a schematic perspective view of an adjustment mechanism according to the embodiment of the present invention.
Figure 6:
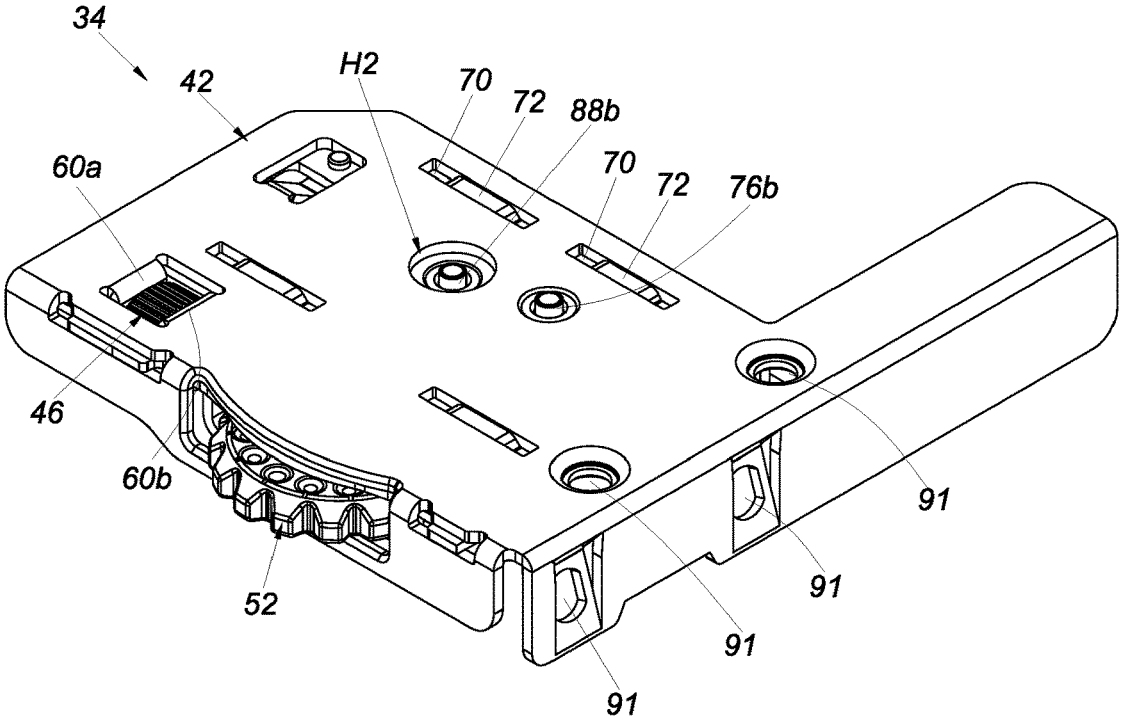
FIG. 6 is a schematic perspective view of the adjustment mechanism according to the embodiment of the present invention from another angle.
Figure 7:
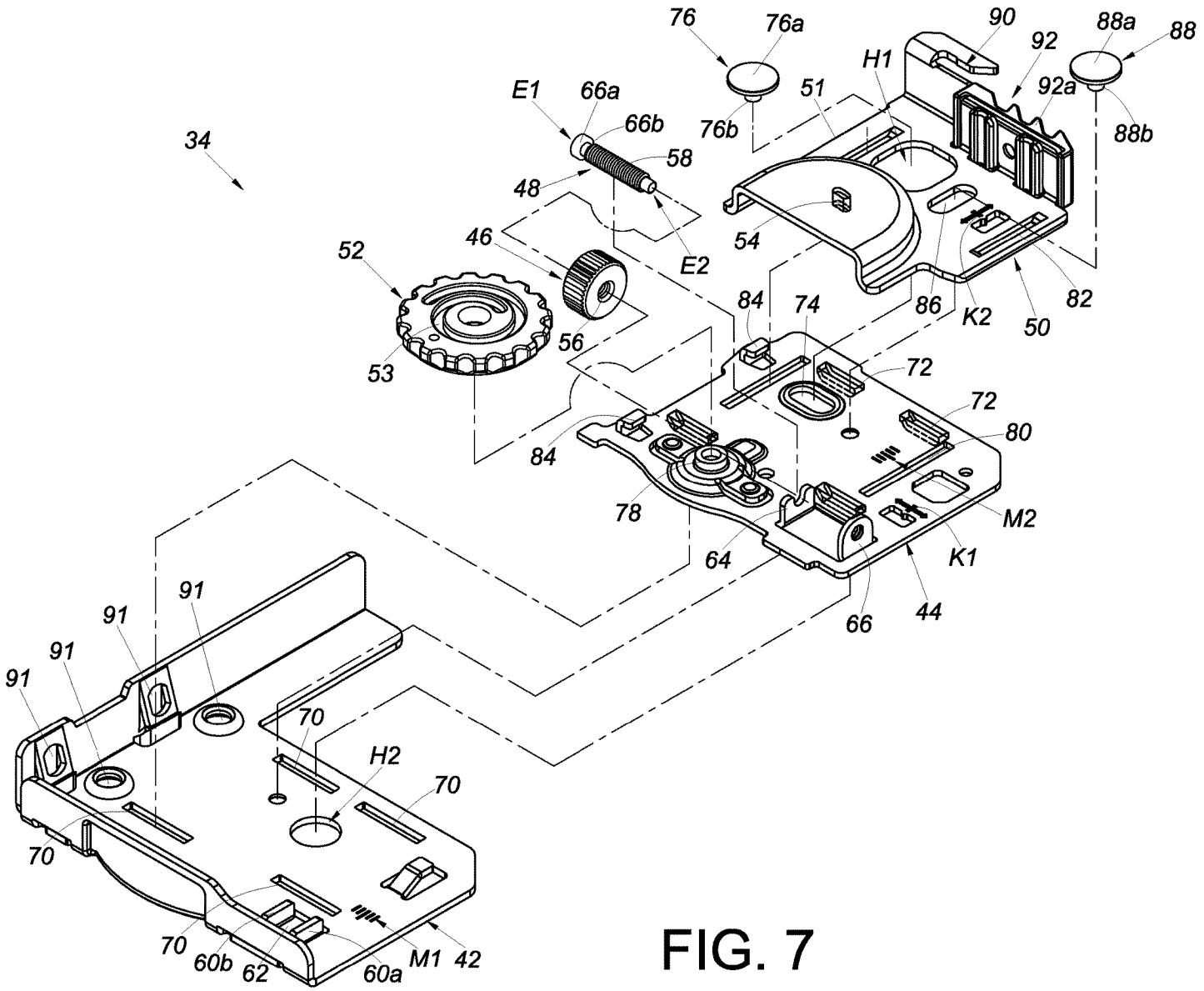
FIG. 7 is an exploded perspective view of the adjustment mechanism according to the embodiment of the present invention.

Preferably, the second component 44 includes at least one guiding structure 84 for keeping at least one corresponding edge portion 51 of the third component 50 in position (see FIG. 5 or FIG. 7). Here, the second component 44 includes two guiding structures 84 by way of example, and each guiding structure 84 has a hook-shape guiding block against which the corresponding edge portion 51 of the third component 50 can abut to help guide the second component 44 and the third component 50 in the correct directions while the two components 44, 50 are being displaced with respect to each other.

Preferably, the third component 50 has a first space H1 larger than the head 76*a* of the first connecting member 76 (see FIG. 5). The first space H1 may be, but is not limited to, a through hole or a groove.

Preferably, the third component 50 includes a transverse opening 86, and the adjustment mechanism 34 further includes a second connecting member 88. The second connecting member 88 includes a head 88*a* and a body 88*b*, wherein the head 88*a* is larger than the body 88*b*. The body 88*b* of the second connecting member 88 passes through a portion of the transverse opening 86 of the third component 50 and is connected to and passes through the second component 44, with the head 88*a* of the second connecting member 88 stopped on one side of the third component 50. Preferably, the first component 42 has a second space H2 larger than the body 88*b* of the second connecting member 88 (see FIG. 6).

Preferably, the third component 50 includes a connecting portion 90 and a flexible arm 92. The connecting portion 90 is configured to connect the third component 50 to a target object (e.g., a slide rail). The flexible arm 92 has a plurality of engaging sections 92*a* for engaging with the target object.

Figure 8:
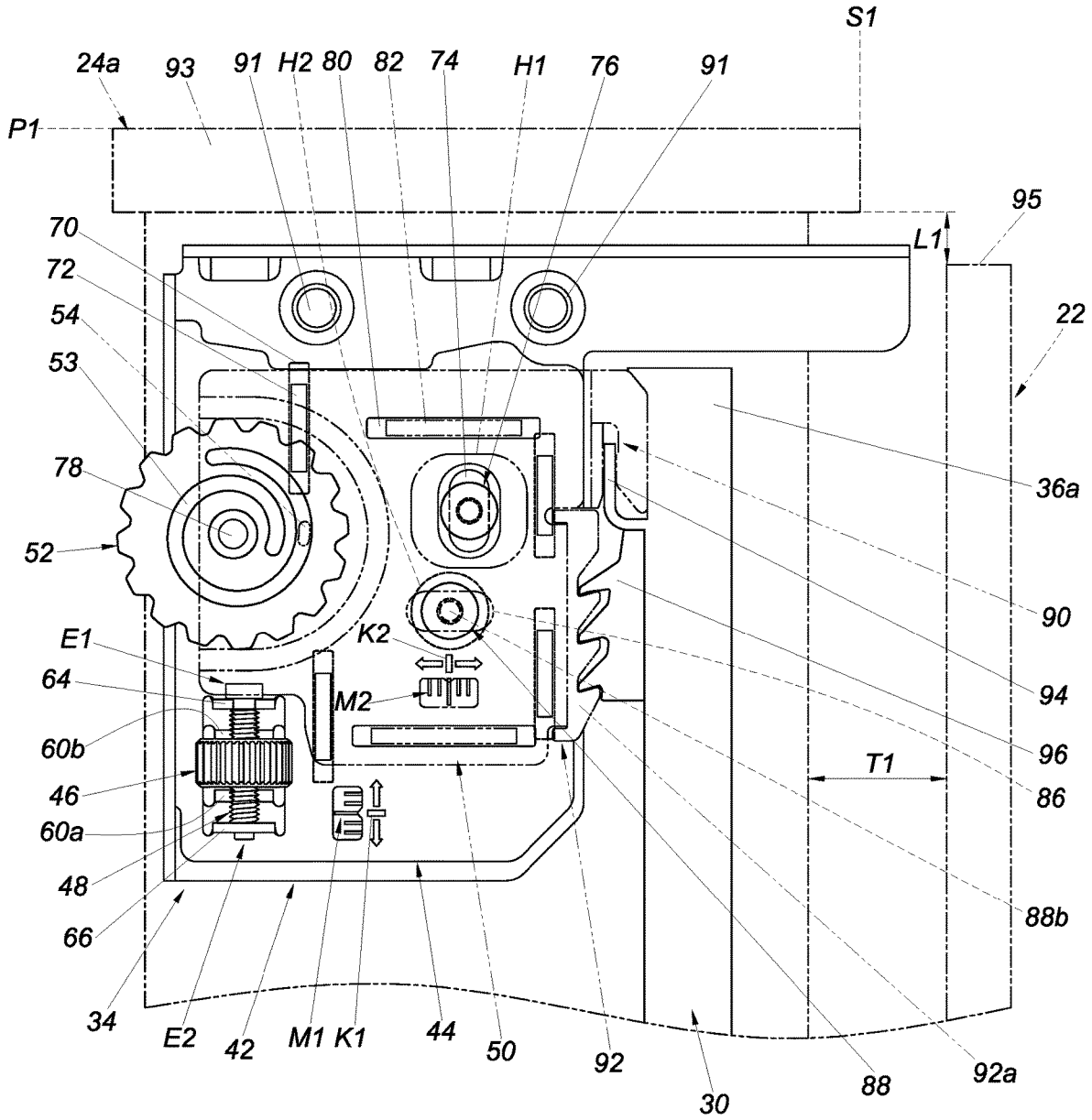
FIG. 8 is a schematic perspective view showing that the second furniture part is mounted on a slide rail of the slide rail assembly via the adjustment mechanism according to the embodiment of the present invention, with a first longitudinal distance and a first transverse distance formed between the second furniture part and the first furniture part.

As shown in FIG. 8, the adjustment mechanism 34 is mounted on the second rail 30. Preferably, the adjustment mechanism 34 is connected to the second rail 30 in a detachable manner. For example, the connecting portion 90 of the third component 50 is a fastening hook configured to hook, and thus be fastened, to a first corresponding part 94 (e.g., a wall section) of the second rail 30. Preferably, the flexible arm 92 of the third component 50 can engage with a second corresponding part 96 of the second rail 30 via the engaging sections 92*a*. Preferably, the engaging sections 92*a* and the second corresponding part 96 have corresponding serrated contours. The first component 42, on the other hand, is configured to connect with the second furniture part 24*a* via at least one connecting feature 91 (e.g., threadedly).

The second furniture part 24*a* can be moved via the second rail 30 to enter an opened or retracted state with respect to the first furniture part 22. Here in FIG. 8, the second furniture part 24*a* is in the retracted state by way of example. As shown in FIG. 8, a first longitudinal distance L1 exists between a front portion 93 (e.g., a front panel) of the second furniture part 24*a* and a front edge 95 of the first furniture part 22 before the first adjusting element 46 is operated, and a first transverse distance T1 exists between a lateral portion of the second furniture part 24*a* and a lateral portion of the first furniture part 22 before the second adjusting element 52 is operated.

Preferably, the first component 42 and the second component 44 have a first scale feature M1 and a first indicator feature K1 respectively, wherein the first scale feature M1 and the first indicator feature K1 are configured to work with each other. The relative positions of the first indicator feature K1 and the first scale feature M1 serve as a visual indicator of the longitudinal (i.e., depth-wise) position to which the second furniture part 24*a* is adjusted with respect to the first furniture part 22 (or the relative longitudinal positions of the first component 42 and the second component 44 after the adjustment). In FIG. 8, in which the first adjusting element 46 has yet to be adjusted (i.e., the relative longitudinal positions of the first component 42 and the second component 44 have yet to be adjusted), the first indicator feature K1 corresponds to a neutral position of the first scale feature M1.

Preferably, the second component 44 and the third component 50 have a second scale feature M2 and a second indicator feature K2 respectively, wherein the second scale feature M2 and the second indicator feature K2 are configured to work with each other. The relative positions of the second indicator feature K2 and the second scale feature M2 serve as a visual indicator of the transverse (i.e., lateral) position to which the second furniture part 24*a* is adjusted with respect to the first furniture part 22 (or the relative transverse positions of the second component 44 and the third component 50 after the adjustment). In FIG. 8, in which the second adjusting element 52 has yet to be adjusted (i.e., the relative transverse positions of the second component 44 and the third component 50 have yet to be adjusted), the second indicator feature K2 corresponds to a neutral position of the second scale feature M2.

Figure 9:
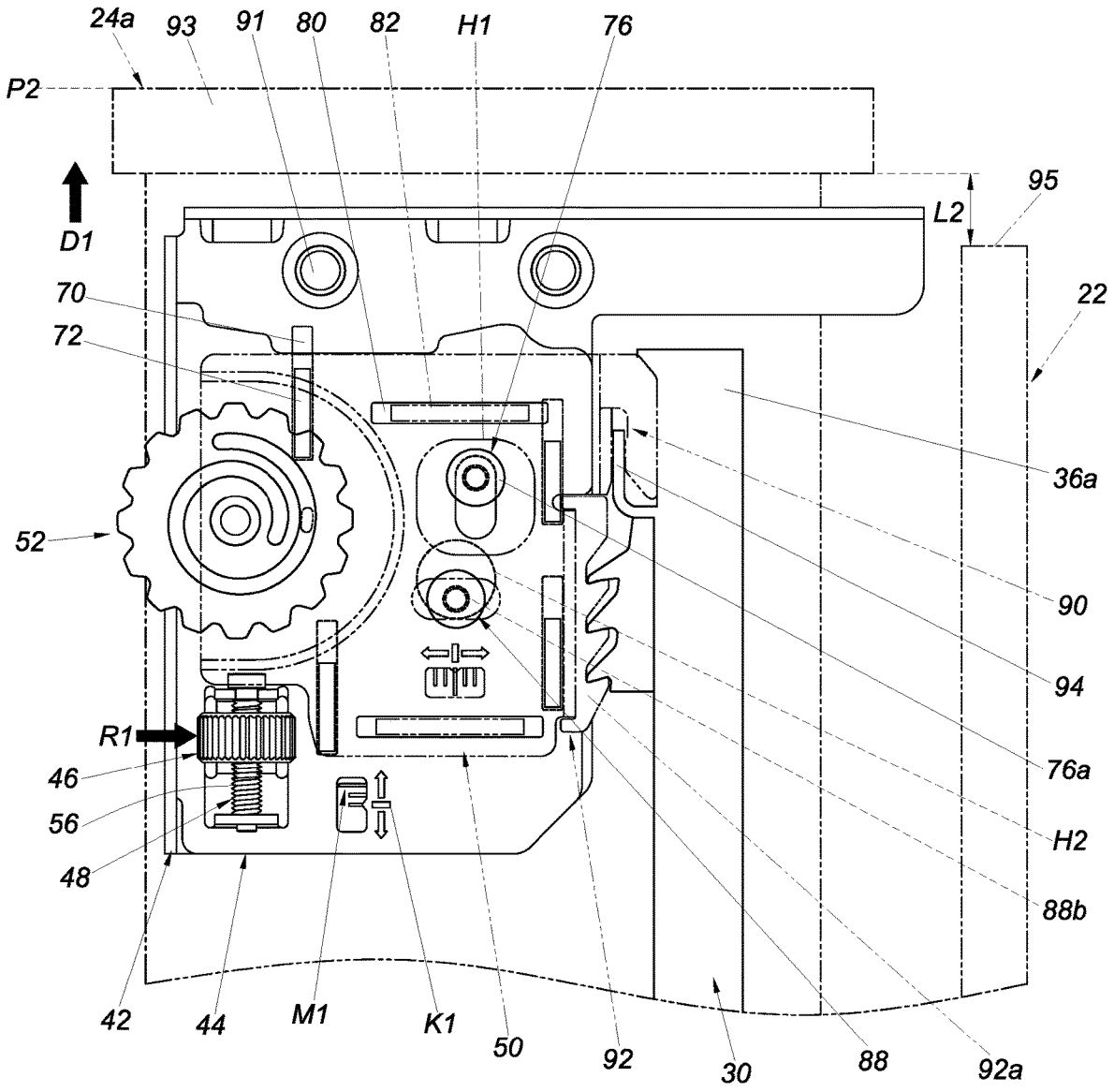
FIG. 9 is a schematic perspective view showing that the second furniture part is longitudinally displaced (i.e., adjusted) via the first adjusting element of the adjustment mechanism according to the embodiment of the present invention, such that a second longitudinal distance is formed between the second furniture part and the first furniture part.

Referring to FIG. 9 in conjunction with FIG. 8, when the first adjusting element 46 is operated, the first feature 56 and the second feature 58 (e.g., an internal thread and an external thread as shown in FIG. 7) work with each other to effect relative longitudinal displacement, and hence relative adjustment, of the second component 44 and the first component 42.

In this embodiment, in which the third component 50 is hooked (and thus fastened) to the second rail 30, the cooperating first and second transverse guiding features 80, 82 of the second and the third components 44, 50 prevent the second component 44 from being longitudinally displaced with respect to the first component 42; in other words, given the configuration of the embodiment, only the first component 42 can be longitudinally displaced with respect to the second component 44 but not the other way around. More specifically, when the first adjusting element 46 is operated by being rotated in a first direction R1, the first structure 48 responds to this operation of the first adjusting element 46 by displacing the first component 42 longitudinally with respect to the second component 44 in a first adjustment direction D1 (e.g., toward the front); as a result, the second furniture part 24*a* is displaced with respect to the first furniture part 22 in the first adjustment direction D1 from a first longitudinal position P1 (see FIG. 8) to a second longitudinal position P2 (see FIG. 9), thereby turning the distance between the front portion 93 of the second furniture part 24*a* and the front edge 95 of the first furniture part 22 from the first longitudinal distance L1 (see FIG. 8) to a second longitudinal distance L2 (see FIG. 9), wherein the second longitudinal distance L2 is greater than the first longitudinal distance L1. Now that the longitudinal position of the first component 42 with respect to the second component 44 is adjusted in the first adjustment direction D1 by operating the first adjusting element 46, the first indicator feature K1 corresponds no more to the neutral position of the first scale feature M1 (see FIG. 8) but to one of the graduation marks of the first scale feature M1 (see FIG. 9), in order for the user to check the adjusted position visually.

Figure 10:
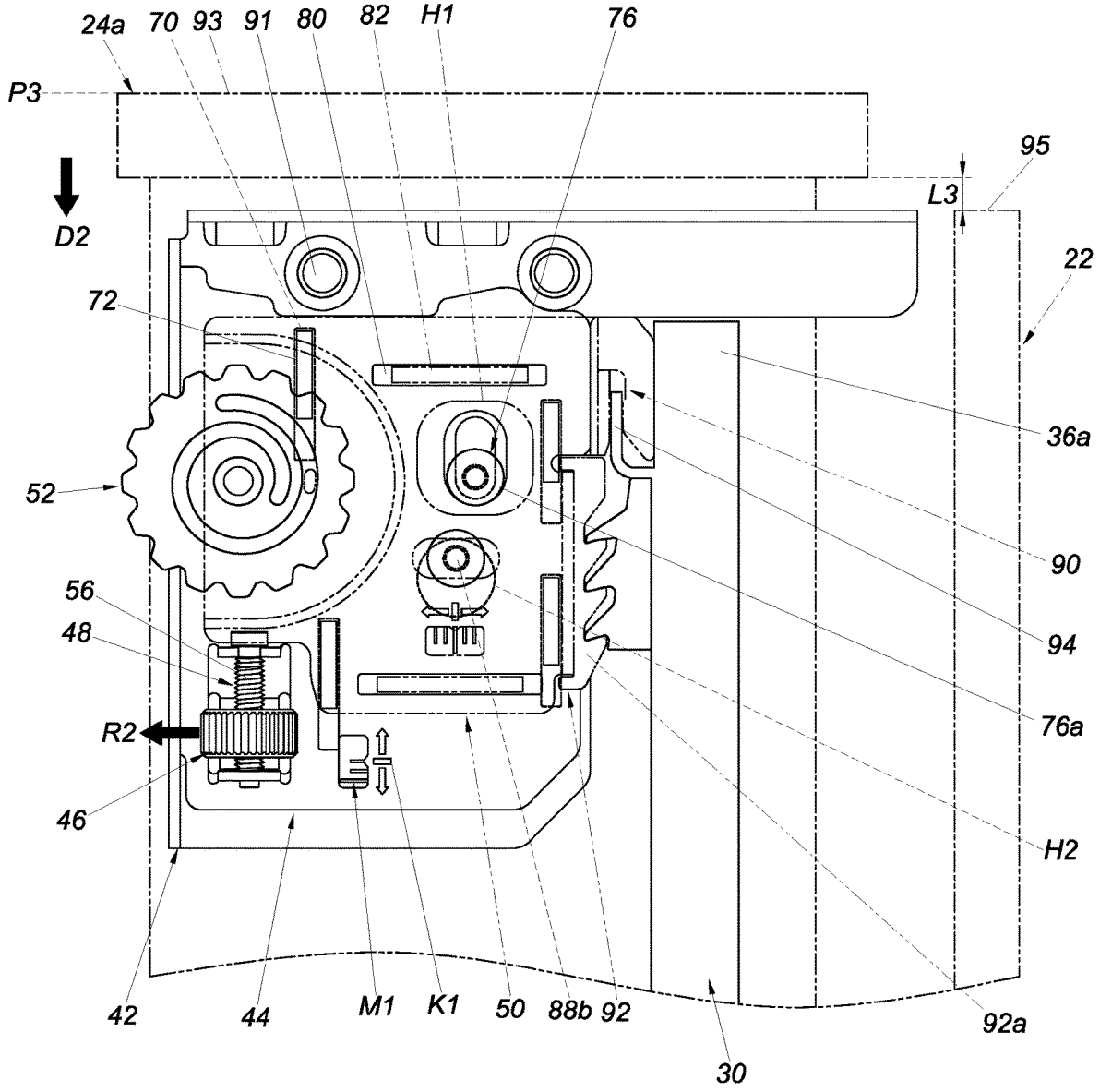
FIG. 10 is a schematic perspective view showing that the second furniture part is longitudinally displaced (i.e., adjusted) via the first adjusting element of the adjustment mechanism according to the embodiment of the present invention, such that a third longitudinal distance is formed between the second furniture part and the first furniture part.

Referring to FIG. 10 in conjunction with FIG. 8, when the first adjusting element 46 is operated by being rotated in a second direction R2, the first structure 48 responds to this operation of the first adjusting element 46 by displacing the first component 42 longitudinally with respect to the second component 44 in a second adjustment direction D2 (e.g., toward the rear); as a result, the second furniture part 24*a* is displaced with respect to the first furniture part 22 in the second adjustment direction D2 from the first longitudinal position P1 (see FIG. 8) to a third longitudinal position P3 (see FIG. 10), thereby turning the distance between the front portion 93 of the second furniture part 24*a* and the front edge 95 of the first furniture part 22 from the first longitudinal distance L1 (see FIG. 8) to a third longitudinal distance L3 (see FIG. 10), wherein the third longitudinal distance L3 is smaller than the first longitudinal distance L1. Now that the longitudinal position of the first component 42 with respect to the second component 44 is adjusted in the second adjustment direction D2 by operating the first adjusting element 46, the first indicator feature K1 corresponds no more to the neutral position of the first scale feature M1 (see FIG. 8) but to one of the graduation marks of the first scale feature M1 (see FIG. 10), in order for the user to check the adjusted position visually.

It is worth mentioning that the first component 42, whose second space H2 is larger than the body 88*b* of the second connecting member 88, does not interfere with the second connecting member 88 when longitudinally displaced with respect to the second component 44 in either the first adjustment direction D1 (see FIG. 9) or the second adjustment direction D2 (see FIG. 10), and that the head 76*a* of the first connecting member 76 does not interfere with the third component 50, whose first space H1 is larger than the head 76*a* of the first connecting member 76, when the first component 42 is longitudinally displaced with respect to the second component 44 in either the first adjustment direction D1 (see FIG. 9) or the second adjustment direction D2 (see FIG. 10).

Figure 11:
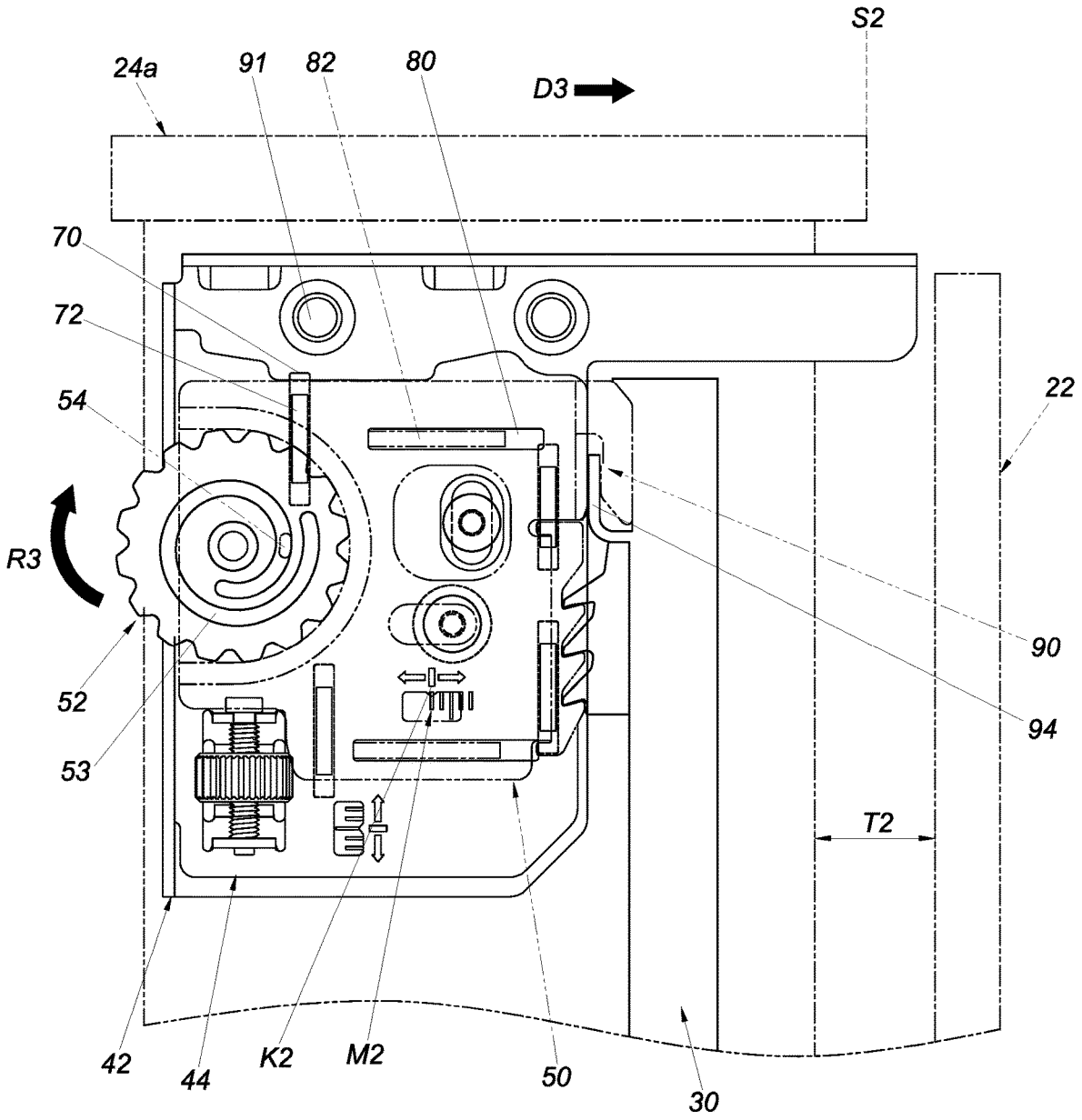
FIG. 11 is a schematic perspective view showing that the second furniture part is transversely displaced (i.e., adjusted) via the second adjusting element of the adjustment mechanism according to the embodiment of the present invention, such that a second transverse distance is formed between the second furniture part and the first furniture part.

Referring to FIG. 11 in conjunction with FIG. 8, when the second adjusting element 52 is operated, the adjusting portion 53 and the second structure 54 work with each other to effect relative transverse displacement, and hence relative adjustment, of the second component 44 and the third component 50.

In this embodiment, in which the third component 50 is hooked (and thus fastened) to the second rail 30, only the second component 44 can be transversely displaced with respect to the third component 50 but not the other way around. The cooperating second and first longitudinal guiding features 72, 70 of the second and the first components 44, 42 cause the second and the first components 44, 22 to be transversely displaced with respect to the third component 50 in unison. More specifically, when the second adjusting element 52 is operated by being rotated in a third direction R3, the second structure 54 is pressed against one of the two sidewalls of the adjusting portion 53 (e.g., a guide groove or a guide channel) and thereby generates a pushing force that displaces the second component 44 and the first component 42 transversely with respect to the third component 50 in a third adjustment direction D3 (e.g., toward the right); as a result, the second furniture part 24*a* is displaced with respect to the first furniture part 22 in the third adjustment direction D3 from a first transverse position S1 (see FIG. 8) to a second transverse position S2 (see FIG. 11), thus turning the distance between the aforesaid lateral portion of the second furniture part 24*a* and the aforesaid lateral portion of the first furniture part 22 from the first transverse distance T1 (see FIG. 8) to a second transverse distance T2 (see FIG. 11), wherein the second transverse distance T2 is smaller than the first transverse distance T1. Now that the transverse position of the second component 44 with respect to the third component 50 is adjusted in the third adjustment direction D3 (e.g., toward the right) by operating the second adjusting element 52, the second indicator feature K2 corresponds no more to the neutral position of the second scale feature M2 (see FIG. 8) but to one of the graduation marks of the second scale feature M2 (see FIG. 11), in order for the user to check the adjusted position visually.

Figure 12:
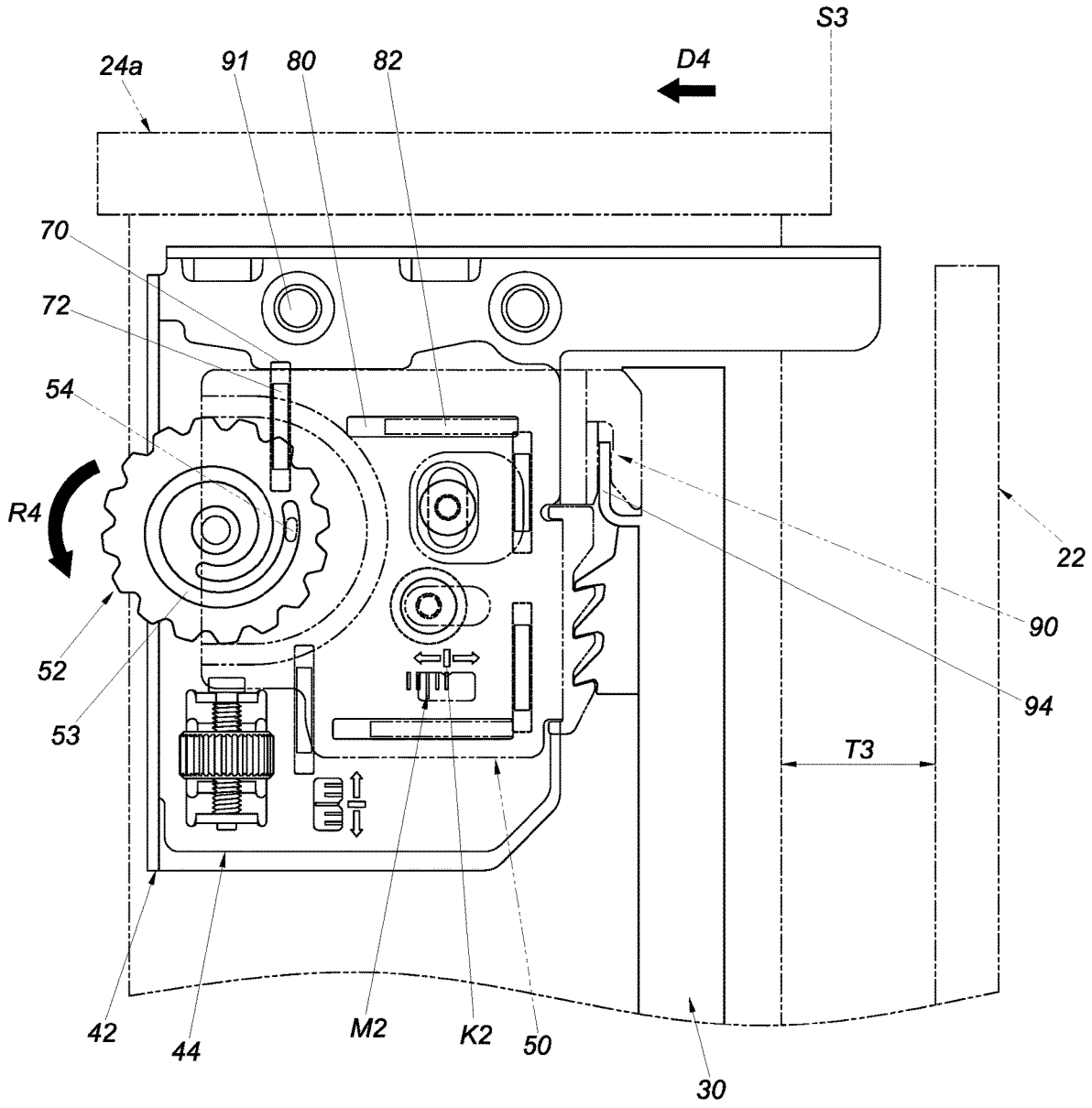
FIG. 12 is a schematic perspective view showing that the second furniture part is transversely displaced (i.e., adjusted) via the second adjusting element of the adjustment mechanism according to the embodiment of the present invention, such that a third transverse distance is formed between the second furniture part and the first furniture part.

Referring to FIG. 12 in conjunction with FIG. 8, when the second adjusting element 52 is operated by being rotated in a fourth direction R4, the second structure 54 is pressed against one of the two sidewalls of the adjusting portion 53 (e.g., a guide groove or a guide channel) and thereby generates a pushing force that displaces the second component 44 and the first component 42 transversely with respect to the third component 50 in a fourth adjustment direction D4 (e.g., toward the left); as a result, the second furniture part 24*a* is displaced with respect to the first furniture part 22 in the fourth adjustment direction D4 from the first transverse position S1 (see FIG. 8) to a third transverse position S3 (see FIG. 12), thus turning the distance between the aforesaid lateral portion of the second furniture part 24*a* and the aforesaid lateral portion of the first furniture part 22 from the first transverse distance T1 (see FIG. 8) to a third transverse distance T3 (see FIG. 12), wherein the third transverse distance T3 is greater than the first transverse distance T1. Now that the transverse position of the second component 44 with respect to the third component 50 is adjusted in the fourth adjustment direction D4 (e.g., toward the left) by operating the second adjusting element 52, the second indicator feature K2 corresponds no more to the neutral position of the second scale feature M2 (see FIG. 8) but to one of the graduation marks of the second scale feature M2 (see FIG. 12), in order for the user to check the adjusted position visually.

It can be known from the above that the adjustment mechanism in the foregoing embodiment preferably has the following features:

1. When the first adjusting element 46 is operated (e.g., rotated), the second component 44 and the first component 42 are longitudinally displaced (i.e., adjusted) with respect to each other through cooperation between the first feature 56 and the second feature 58.
2. Longitudinal (i.e., depth-wise) and transverse (i.e., lateral) adjustment can be achieved by relative longitudinal displacement of the first component 42 and the second component 44, relative transverse displacement of the second component 44 and the third component 50, and cooperation between the two adjusting elements 46, 52 and the two structures 48, 54.
3. The adjustment mechanism 34 can displace (i.e., adjust) an object (e.g., the second furniture part 24*a*) with respect to the first furniture part 22 in four directions (i.e., the first to the fourth adjustment directions D1 to D4, e.g., toward the front, rear, right, and left) in order to deal with or compensate for mounting errors that may exist between the object (e.g., the second furniture part 24*a*) and the first furniture part 22 (or a slide rail).
4. The adjustment mechanism 34 is mounted on (e.g., detachably connected to) a slide rail (e.g., the second rail 30) and/or an object (e.g., the second furniture part 24*a*).
5. The axis of the first adjusting element 46 is substantially perpendicular to that of the second adjusting element 52;

in other words, the first structure 48 is disposed in a direction that is perpendicular to the direction in which the shaft portion 78 is disposed.

6. The cooperating first scale feature M1 and first indicator feature K1 of the first and the second components 42, 44 enable the user to visually check the longitudinal (i.e., depth-wise) position to which the second furniture part 24*a* is adjusted with respect to the first furniture part 22 (or the relative longitudinal positions of the first component 42 and the second component 44) Similarly, the cooperating second scale feature M2 and second indicator feature K2 of the second and the third components 44, 50 enable the user to visually check the transverse (i.e., lateral) position to which the second furniture part 24*a* is adjusted with respect to the first furniture part 22 (or the relative transverse positions of the second component 44 and the third component 50).

While the present invention has been disclosed through the preferred embodiment described above, the embodiment is not intended to be restrictive of the scope of the invention. The scope of patent protection sought by the applicant is defined by the appended claims.

What is claimed is:

1. An adjustment mechanism, comprising:

a first adjustment device including:

a first component;

a second component, the second component having a longitudinal opening;

a first adjusting element disposed on the first component; and a first structure disposed on the second component;

wherein the first adjusting element and the first structure include a first feature and a second feature respectively, and the first feature and the second feature correspond to each other;

wherein when the first adjusting element is operated, the first feature and the second feature work with each other to longitudinally displace, and thereby adjust, the second component and the first component with respect to each other;

a first connecting member, the first connecting member includes a head and a body, the head is larger than the body, the body of the first connecting member extends through a portion of the longitudinal opening and is connected to the first component, and the head of the first connecting member is stopped on a side of the second component; and a second adjustment device, the second adjustment device including:

a third component;

a second adjusting element disposed on the second component; and a second structure disposed on the third component;

wherein the second adjusting element includes an adjusting portion, and wherein when the second adjusting element is operated, the adjusting portion and the second structure work with each other to transversely displace, and thereby adjust, the second component and the third component with respect to each other.

2. The adjustment mechanism of claim 1, wherein the first feature of the first adjusting element and the second feature of the first structure are threadedly engaged screw threads.

3. The adjustment mechanism of claim 2, wherein the first adjusting element is a turning wheel, the first structure is a rod, the first structure is substantially longitudinally disposed with respect to the second component, and the first adjusting element is configured to be operated by rotation about an axis defined by the first structure.

4. The adjustment mechanism of claim 3, wherein the first component includes a pair of walls, and the pair of walls define a space therebetween for accommodating the first adjusting element; and wherein the second component includes a mounting portion for supporting the first structure, and the first structure has a first abutting portion and a second abutting portion located respectively on two opposite sides of the mounting portion.

5. The adjustment mechanism of claim 4, wherein the first adjusting element is slightly smaller than the space and therefore able be operated by rotation about the axis defined by the first structure, and the pair of walls prevent the first adjusting element from being longitudinally displaced.

6. The adjustment mechanism of claim 1, wherein the first component and the second component include a first longitudinal guiding feature and a second longitudinal guiding feature respectively, the first longitudinal guiding feature and the second longitudinal guiding feature are configured to work with each other, and one of the first longitudinal guiding feature and the second longitudinal guiding feature is larger than the other of the first longitudinal guiding feature and the second longitudinal guiding feature.

7. The adjustment mechanism of claim 6, wherein the first longitudinal guiding feature is a recess or a hole, and the second longitudinal guiding feature is a protruding portion.

8. The adjustment mechanism of claim 1, wherein the second adjusting element is a turning wheel, the second structure is a projection, the adjusting portion of the second adjusting element is a generally spiral guide groove, and the second structure is in the guide groove.

9. The adjustment mechanism of claim 1, wherein the second component and the third component include a first transverse guiding feature and a second transverse guiding feature respectively, the first transverse guiding feature and the second transverse guiding feature are configured to work with each other, and one of the first transverse guiding feature and the second transverse guiding feature is larger than the other of the first transverse guiding feature and the second transverse guiding feature.

10. The adjustment mechanism of claim 1, wherein the second component includes at least one guiding structure for keeping at least one corresponding edge portion of the third component in place.

11. The adjustment mechanism of claim 1, wherein the third component includes a first space, and the first space is larger than the head of the first connecting member.

12. The adjustment mechanism of claim 1, further comprising a second connecting member, wherein the second connecting member includes a head and a body, the head of the second connecting member is larger than the body of the second connecting member, the third component includes a transverse opening, the body of the second connecting member extends through a portion of the transverse opening of the third component and is connected to the second component, and the head of the second connecting member is stopped on a side of the third component.

13. The adjustment mechanism of claim 12, wherein the first component includes a second space, and the second space is larger than the body of the second connecting member.

14. The adjustment mechanism of claim 1, wherein the third component includes a connecting portion for connecting the third component to a target object.

15. The adjustment mechanism of claim 14, wherein the third component further includes a flexible arm, and the flexible arm has a plurality of engaging sections for engaging with the target object.

16. An adjustment mechanism for use with a slide rail, the adjustment mechanism comprising:

a first component connectable to an object carried by the slide rail;

a second component;

a first adjusting element disposed on one of the first component and the second component, the first adjusting element is a turning wheel;

a first structure disposed on the other of the first component and the second component, the first structure is a rod, the first structure being substantially longitudinally disposed with respect to the second component, and the first adjusting element being configured to be operated by rotation about an axis defined by the first structure, wherein the first component includes a pair of walls, and the pair of walls define a space therebetween for accommodating the first adjusting element, and the second component includes a mounting portion for supporting the first structure, and the first structure has a first abutting portion and a second abutting portion located respectively on two opposite sides of the mounting portion, and the first adjusting element being slightly smaller than the space and therefore able to be operated by rotation about the axis defined by the first structure, and the pair of walls prevent the first adjusting element from being longitudinally displaced;

a third component connectable to the slide rail;

a second adjusting element disposed on one of the second component and the third component; and a second structure disposed on the other of the second component and the third component;

wherein the first adjusting element and the first structure include a first feature and a second feature respectively, and the first feature and the second feature correspond to each other and are configured to work with each other to convert a rotation of the first adjusting element into a longitudinal displacement of the first component with respect to the second component, thereby adjusting a longitudinal position of the object with respect to the slide rail, the first feature of the first adjusting element and the second feature of the first structure being threadedly engaged screw threads, the second component including a mounting portion for supporting the first structure, and the first structure having a first abutting portion and a second abutting portion located respectively on two opposite sides of the mounting portion;

wherein the second adjusting element includes an adjusting portion, and the adjusting portion and the second structure are configured to work with each other to convert a rotation of the second adjusting element into a transverse displacement of the second component with respect to the third component, thereby adjusting a transverse position of the object with respect to the slide rail.

17. An adjustment mechanism for use with a slide rail, the adjustment mechanism comprising:

a first component connectable to an object carried by the slide rail;

a second component;

a first adjusting element disposed on one of the first component and the second component;

a first structure disposed on the other of the first component and the second component;

a third component connectable to the slide rail;

a second adjusting element disposed on one of the second component and the third component, the second adjusting element is a turning wheel; and a second structure disposed on the other of the second component and the third component, the second structure is a projection;

wherein the first adjusting element and the first structure include a first feature and a second feature respectively, and the first feature and the second feature correspond to each other and are configured to work with each other to convert a rotation of the first adjusting element into a longitudinal displacement of the first component with respect to the second component, thereby adjusting a longitudinal position of the object with respect to the slide rail;

wherein the second adjusting element includes an adjusting portion, and the adjusting portion and the second structure are configured to work with each other to convert a rotation of the second adjusting element into a transverse displacement of the second component with respect to the third component, thereby adjusting a transverse position of the object with respect to the slide rail;

wherein the adjusting portion of the second adjusting element is a generally spiral guide groove, and the second structure is in the guide groove in order for the adjusting portion and the second structure to work with each other to convert the rotation of the second adjusting element into the transverse displacement of the second component with respect to the third component;

wherein the second component and the third component include a first transverse guiding feature and a second transverse guiding feature respectively, the first transverse guiding feature and the second transverse guiding feature are configured to work with each other, and one of the first transverse guiding feature and the second transverse guiding feature is larger than the other of the first transverse guiding feature and the second transverse guiding feature; and wherein the third component includes a connecting portion for connecting the third component to the slide rail in a detachable manner.

* * * * *